United States Patent [19]

Johnson

[11] Patent Number: 4,920,841

[45] Date of Patent: May 1, 1990

[54] ENERGY DISSIPATING RECEPTACLE

[75] Inventor: Christopher L. Johnson, Fort Worth, Tex.

[73] Assignee: General Dynamics Corporation, Fort Worth, Tex.

[21] Appl. No.: 291,680

[22] Filed: Dec. 29, 1988

[51] Int. Cl.[5] ..... B24C 5/00

[52] U.S. Cl. ..... 83/177; 83/53; 51/321

[58] Field of Search ..... 83/177, 53; 51/319, 51/321, 331, 410, 424

[56] References Cited

U.S. PATENT DOCUMENTS 4,827,679 5/1989 Earle, III ..... 83/177

FOREIGN PATENT DOCUMENTS 3518166 11/1986 Fed. Rep. of Germany ..... 83/177

2612115 9/1988 France ..... 83/177

*Primary Examiner*—Frank T. Yost

*Assistant Examiner*—Hwei-Siu Payer

*Attorney, Agent, or Firm*—Charles D. Gunter, Jr.

[57] ABSTRACT

An energy dissipating receptacle is shown which includes a body having an internal cavity and an aperture for receiving a high velocity stream of fluid. A stream dissipator is located within the internal cavity in alignment with the high velocity stream to dissipate the energy associated with this stream at an area of contact. A motor is provided for rotating the stream dissipator contact surface to increase the area of contact with the high velocity stream and increase the useful life of the stream dissipator.

8 Claims, 1 Drawing Sheet

ENERGY DISSIPATING RECEPTACLE

BACKGROUND OF THE INVENTION

1. Field of the Invention

The present invention relates to fluid jet cutting devices and, specifically, to an energy-dissipating receptacle for use with such a device.

2. Description of the Prior Art

A variety of prior art systems are known for cutting by means of a high velocity fluid jet. Such systems utilize a fluid, such as water or abrasive-laden water. The stream of fluid is forced through a jewel nozzle having a diameter on the order of 0.001 to 0.030 inches to generate a jet having a velocity on the order of 3,000 feet per second. The high velocity fluid jet thus produced can be used to cut through a variety of metallic and non-metallic materials including steel, aluminum, paper, rubber, and plastic. Where the fluid has abrasive materials added, the abrasive jet can be used to cut a variety of harder materials such as tool steel, armour plate, certain ceramics, and advanced composites such as graphite/epoxy laminates. The abrasive materials added to the fluid stream include garnet, silica, aluminum oxide, and silicon carbide.

Once the high velocity fluid jet has passed through the workpiece being cut, the high energy fluid stream which remains must be dissipated. That is, the energy must be converted partially from kinetic energy to heat, and also dissipated in the sense of breaking up the coherent stream of the high velocity fluid jet into smaller streams having less concentrated kinetic energy. Without the proper catcher or receptacle, the high energy fluid stream poses a danger to personnel and equipment. Additionally, the fluid forming the stream must be collected for proper disposal.

Traditional methods for dealing with the high velocity fluid stream have included aiming the stream into a water pit in the floor or using a steel cylinder filled with water and garnet to stop the high velocity stream within a few feet. More recent receptacles have used various kinds of stream dissipating materials in an effort to reduce the receptacle size. One known design uses steel balls contained in a canister and slowly consumed by the high velocity fluid stream.

The known receptacle devices have suffered from various deficiencies. For instance, excessive wear in use requires that the components of the catcher portion of the device be replaced or resupplied frequently. Also, the prior art receptacles have been large and expensive due to both the quality and quantity of the required materials. The excessive length of the prior art devices also precluded using such devices in confined spaces.

A need exists for an energy dissipating receptacle which is smaller in size, containing a primary energy dissipating element that can be placed more closely to the fluid stream exit at the nozzle of the fluid jet device.

A need also exists for such a receptacle which provides an energy dissipating element which is less subject to excessive wear to thereby increase the useful life of the device.

Additional objects, features and advantages will be apparent from the written description which follows.

SUMMARY OF THE INVENTION

The energy dissipating receptacle of the invention is adapted to receive a high velocity stream of fluid and abrasive from a fluid jet cutting device. The receptacle includes a body having an internal cavity and an aperture for receiving the high velocity stream of fluid. A stream dissipator is located within the internal cavity in alignment with the high velocity stream of fluid for dissipating the energy associated with the high velocity stream at an area of contact once it has passed within the internal cavity. Rotating means are provided for rotating the stream dissipator within the internal cavity to thereby increase the area of contact with the high velocity stream of fluid and abrasive and increase the useful life of the stream dissipator.

Preferably, the stream dissipator is a disc mounted on a pedestal within the internal cavity of the receptacle body. The disc includes a flat surface which is placed in the high velocity fluid stream but oriented 90 degrees from the stream for dissipating the energy associated with the fluid stream. The rotating means rotates the flat surface of the disc within the internal cavity to thereby increase the area of contact with the high velocity stream.

DETAILED DESCRIPTION OF THE INVENTION

Figure 1:
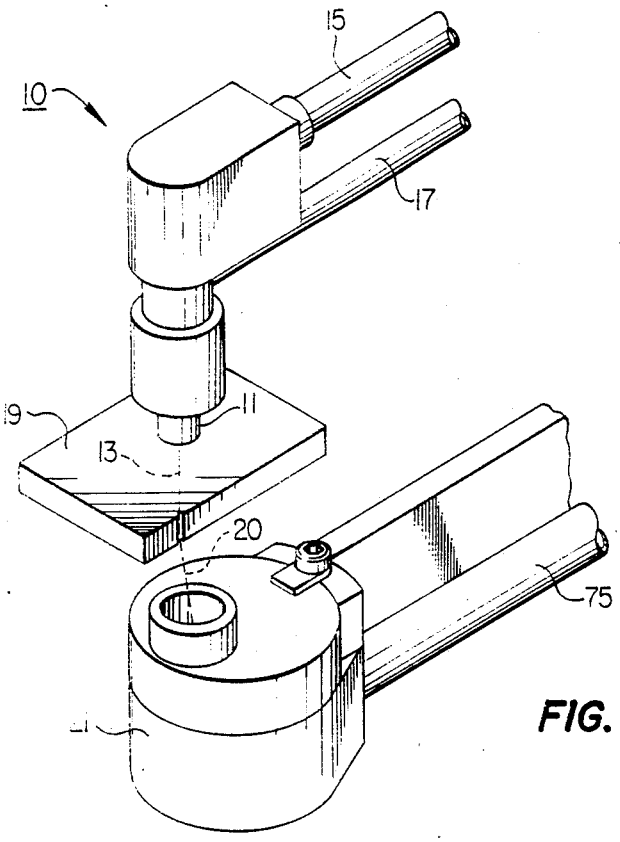
FIG. 1 is an elevational view, partially schematic, of a fluid jet cutting device constructed according to the present invention.

FIG. 1 shows a fluid jet cutting device 10 including a nozzle 11 for producing a high velocity fluid jet 13. As will be familiar to those skilled in the art, a fluid line 15 introduces fluid to the device 10 while an abrasive line 17 optionally introduces an abrasive material Typically, the fluid is water, or a water-abrasive laden mixture. The fluid in stream 13 first passes through a jewel orifice located within the device 10 having a diameter from about 0.001 to 0.030 inches, preferably 0.007 to 0.014 inches. After passing through the jewel orifice, the fluid enters a venturi passage where abrasive is added. The abrasive laden fluid then exits a carbide nozzle 11 at a velocity on the order of 3,000 feet per second.

A workpiece, such as the sheet of material 19, is positioned below the nozzle 11 for penetration by the high velocity jet 13. In the embodiment shown in FIG. 1, the upper surface of the material 19 is oriented in a plane perpendicular to the direction of travel of the fluid jet 13. Typically, the material 19 is moved in a transverse direction relative to the fluid jet 13 to make a cut in a predetermined pattern.

As the workpiece 19 is being cut, the fluid jet 13 passes through the material with the remaining high velocity fluid stream 20 entering an energy dissipating receptacle 21. In the arrangement shown in FIG. 1, the fluid jet 13 emerges from the nozzle 11 in a downward, vertical direction. The receptacle 21 is accordingly located directly beneath the workpiece 19 in vertical alignment with the jet 13 and at a distance of about 1–2 inches from the nozzle exit. As will be explained, other orientations of the nozzle 11 and receptacle 21 are possible. For instance, the receptacle could be located in general horizontal alignment with the nozzle.

Figure 2:
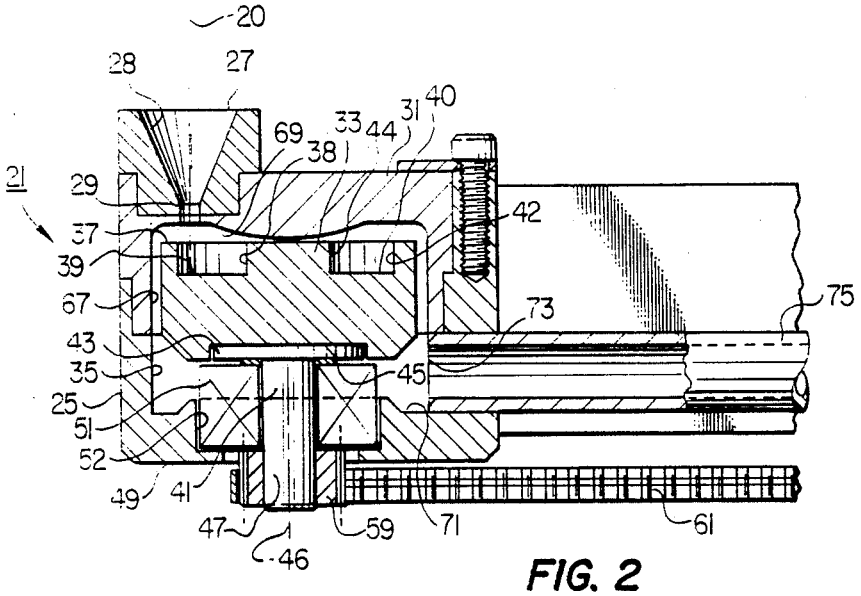
FIG. 2 is a partial, sectional view of the energy dissipating receptacle of the invention which is used to receive the high velocity fluid stream from the fluid jet cutting device.

Turning to FIG. 2, the energy dissipating receptacle 21 is shown sectioned for ease of understanding. The receptacle 21 includes a body 25, typically formed of aluminum with an aperture 27 for receiving a high velocity stream of fluid 20. The side walls 28 of the aperture 27 converge in a downward vertical direction to join a vertical passage 29 which extends downwardly through the chamber upper containment plate 31 into an internal cavity 35 provided within the body 25. The side walls 28 and vertical passage 29 together form a venturi-shaped opening into the body 25. After passing through the vertical passage 29, the high velocity stream 20 impinges upon a dissipating means, such as stream dissipator 33 located within the internal cavity 35.

The stream dissipator 33 is preferably a disc having a flat upper surface 37 which is aligned with the high velocity stream 20 but oriented in a 90° plane relative thereto. The flat upper surface 37 is provided with a groove or channel 38 for dissipating the energy associated with the high velocity stream 20 at an area of contact 39 within the groove 38. Groove 38 forms a circumferential path about the periphery of the disc flat upper surface 37 and is approximately rectangular in cross-section having a flat bottom 40 and vertical sidewalls 42, 44, as viewed in FIG. 2. The disc 33 along with plate 31 and aperture 27 are formed of a wear resistant material. Such materials can include, for instance, polycrystalline diamond, tungsten carbide, high-grade ceramic, and carbide/ceramic. The preferred material is sintered tungsten carbide because of its acceptable life and relatively low cost.

The receptacle 21 is provided with a means for increasing the impingement area of the high velocity stream 20 by rotation, translation or reciprocation of the stream dissipator 33. Preferably, rotating means are provided for rotating the stream dissipator 33 in the 90° plane with respect to the high velocity stream 13 to increase the area of contact 39 with the high velocity stream in a circumferential path within the groove 38. By thus varying the contact area with the high velocity stream 13, it is possible to increase the useful life of the dissipator 33.

In the embodiment shown, the rotating means includes a pedestal 41 having an upper extent 43 which is joined to the lower surface 45 of the stream dissipator 33 for rotation therewith and having a downwardly extending lower extent 47 which protrudes through the bottom wall 49 of the body 25. The vertical axis 46 of the pedestal 41 is offset from the path of high velocity stream 20 so that the stream 20 will track in a circular path within groove 38. The stream dissipator 33 can be glued to the pedestal 41 using RTV silicone sealant. A conventional sealed bearing assembly 51 supports the pedestal 41 for rotational movement within the internal cavity 35. The bearing assembly 51 forms a light interference fit within a bottom recess 52 provided in the internal cavity.

The pedestal lower extent 47 is provided with a miniature pulley 59 for engaging drive means 61 used to rotate the pedestal 41 and, in turn, the stream dissipator 33. The drive means can comprise, for instance, a belt which is driven by the output shaft of an electric motor (not shown). A rotational speed on the order of one cycle per second has been found to be acceptable.

As seen in FIG. 2, the flat bottom 40 of the groove 38 comprises the primary stream dissipator for the high velocity fluid stream 20. Secondary dissipation takes place when the high velocity streams reflected off the flat bottom 40 strike the groove vertical sidewalls 42, 44 and the interior surface 69 of the internal cavity upper plate 31. The internal cavity cylindrical sidewalls 67 and upper plate 31 are also preferably lined or comprised of a wear resistant material such as tungsten carbide.

After being dissipated against the stream dissipator 33, the water/abrasive slurry exits the chamber to a collector means provided to collect dissipated fluid. The collector means includes a circumferential groove 71 provided in the bottom of the receptacle body 25 which opens to the internal cavity 35. Collected fluid passes through an exit opening 73 and a discharge pipe 75 to a waste collector such as a canister or pit (not shown). A vacuum system for removal of dissipated slurry can be used to ensure complete removal of the slurry.

An invention has been provided with several advantages. The energy dissipating receptacle of the invention can be provided in a compact size which allows it to be utilized in closely confined spaces and in a multitude of positions Because of its decreased size, the receptacle can be placed very close to the fluid jet exit stream at the nozzle. The rotating stream dissipator exhibits a longer useful life than prior art dissipating surfaces due to the increased area of contact with the high velocity fluid stream. The device is simple in design and economical to manufacture. Because the receptacle does not rely upon steel balls or collected water and garnet which would fall out in a non-vertical orientation, the receptacle can work in various orientations while allowing the same closely spaced relationship between the nozzle and receptacle.

While the invention has been shown in only one of its forms, it is not thus limited but is susceptible to various changes and modifications without departing from the spirit thereof.

I claim:

1. An energy dissipating receptacle for receiving a high velocity stream of fluid, comprising:

a body having an internal cavity and an aperture for receiving said high velocity stream of fluid;

dissipating means located within said internal cavity in alignment with said high velocity stream of fluid including a planar surface arranged normal to the direction of said high velocity stream of fluid for dissipating the energy associated with said high velocity stream of fluid at a point of contact once it has passed within said internal cavity; and drive means for mechanically varying the position of the dissipating means within said internal cavity to thereby vary the point of contact of said high velocity stream of fluid with said dissipating means and increase the useful life of said dissipating means.

2. An energy dissipating receptacle for receiving a high velocity stream of fluid, comprising:

a body having an internal cavity and an aperture for receiving said high velocity stream of fluid;

dissipating means located within said internal cavity in alignment with said high velocity stream of fluid including a planar surface arranged normal to the direction of said high velocity stream of fluid for dissipating the energy associated with said high velocity stream of fluid at a point of contact once it has passed within said internal cavity; and a mechanically driven rotating means for rotating said dissipating means within said internal cavity to thereby vary the point of contact of said high velocity stream of fluid with said dissipating means and increase the useful life of said dissipating means.

3. The energy dissipating receptacle of claim 2, wherein said dissipating means is a disc mounted on a pedestal within said internal cavity, said pedestal being rotated by said mechanically driven rotating means.

4. The energy dissipating receptacle of claim 3, wherein said disc has a flat upper surface with a circumferential groove provided therein, said groove forming a circular path about the outer periphery of said disc flat upper surface, and wherein said point of contact of said high velocity stream of fluid is located within said groove.

5. An energy dissipating receptacle for receiving a high velocity stream of fluid, comprising:

a body having an internal cavity and an aperture for receiving said high velocity stream of fluid;

a disc mounted on a pedestal located within said internal cavity, said disc having a planar surface arranged normal to the direction of said high velocity stream of fluid, said planar surface having a circumferential groove, said groove having a flat bottom located in alignment with said high velocity stream of fluid and oriented in a 90 degree plane thereto for dissipating the energy associated with said high velocity stream of fluid at a point of contact once it has passed within said internal cavity; and a mechanically driven rotating means operably connected to said pedestal for rotating said disc in said 90 degree plane within said internal cavity to thereby vary the point of contact of said high velocity stream of fluid within said circumferential groove located on the flat surface of said disc to increase the useful life of said disc.

6. The energy dissipating receptacle of claim 5, wherein said groove flat bottom comprises the primary energy dissipator for said high velocity stream of fluid for deflecting said stream of fluid, said groove having vertical sidewalls which act as a secondary dissipator for said deflected stream.

7. An apparatus for cutting by means of a high velocity fluid stream, said apparatus comprising:

a working nozzle supplying a high velocity fluid stream;

a material to be cut, said material being located below said working nozzle in alignment with said high velocity fluid stream;

an energy dissipating receptacle located opposite said material to be cut for receiving said high velocity stream of fluid, said receptacle comprising:

a body having an internal cavity and an aperture for receiving said high velocity stream of fluid;

dissipating means located within said internal cavity in alignment with said high velocity stream of fluid and oriented in a 90 degree plane thereto for dissipating the energy associated with said high velocity stream of fluid at a point of contact once it has passed within said internal cavity; and a mechanically driven rotating means for rotating the dissipating means in said 90 degree plane within said internal cavity to thereby vary the point of contact with said high velocity stream of fluid in a circumferential path about the dissipating means to increase the useful life of said dissipating means.

8. In a fluid jet cutting operation of the type utilizing a high velocity fluid stream, a method for dissipating the energy of said high velocity fluid stream entering a fluid receptacle, comprising the steps of:

providing said fluid receptacle with a body having an internal cavity and an aperture for receiving said high velocity stream of fluid;

locating dissipating means within said internal cavity in alignment with said high velocity stream of fluid and oriented in a 90 degree plane thereto for dissipating the energy associated with said high velocity stream of fluid at a point of contact once it has passed within said internal cavity; and rotating the dissipating means in said 90 degree plane within said internal cavity as said fluid jet cutting operation is taking place to thereby vary the point of contact with said high velocity stream of fluid in a circumferential path about the dissipating means to increase the useful life of said dissipating means.

* * * * *